United States Patent [19]

Pacht

[11] Patent Number: 4,593,858

[45] Date of Patent: Jun. 10, 1986

[54] FAIL-SAFE HIGH PRESSURE FLUID DELIVERY SYSTEM

[75] Inventor: Amos Pacht, Houston, Tex.

[73] Assignee: Butterworth, Inc., Houston, Tex.

[21] Appl. No.: 719,003

[22] Filed: Apr. 1, 1985

[51] Int. Cl.[4] ..... B05B 9/03

[52] U.S. Cl. ..... 239/126; 137/614.11; 239/527; 239/574; 239/586; 251/30.05

[58] Field of Search ..... 239/124, 126, 127, 527, 239/528, 574, 586; 137/614.11; 251/30.02, 30.05, 63.4, 63.5

[56] References Cited

U.S. PATENT DOCUMENTS

| | | | |
|---|---|---|---|
| 2,573,369 | 10/1951 | Snoddy | 251/30.05 |
| 2,634,754 | 4/1953 | Rahn | 137/658 |
| 2,758,812 | 8/1956 | Peterson | 251/29 |
| 2,805,037 | 9/1957 | Bruce | 251/25 |
| 2,918,072 | 12/1959 | Boler | 137/38 |
| 2,991,940 | 7/1961 | Dupler et al. | 239/527 |
| 3,112,094 | 11/1963 | Nees et al. | 251/30.02 |
| 3,140,049 | 7/1964 | Norstrud et al. | 239/126 |
| 3,491,948 | 1/1970 | Alexander | 239/127 |
| 3,575,348 | 4/1971 | MacKay | 239/127 |
| 3,690,558 | 9/1972 | Tuttle | 239/127 |
| 3,765,607 | 10/1973 | Pacht | 239/124 |
| 3,831,845 | 8/1974 | Pacht | 239/76 |
| 3,885,739 | 5/1975 | Tuttle | 239/124 |
| 3,986,523 | 10/1976 | Pacht | 137/610 |
| 4,349,154 | 9/1982 | Pacht | 239/124 |
| 4,373,588 | 2/1983 | White | 261/63.4 |
| 4,391,183 | 7/1983 | Broms et al. | 91/461 |

FOREIGN PATENT DOCUMENTS 2017266A 10/1979 United Kingdom .

*Primary Examiner*—Joseph F. Peters, Jr.
*Assistant Examiner*—Michael J. Forman
*Attorney, Agent, or Firm*—Donald F. Wohlers

[57] ABSTRACT

The present invention contemplates a fluid delivery system for use with one or more individual water blast guns, each of which have an auxiliary shut-off valve integral with the gun and also include electric circuit completion means for operating a pneumatic secondary shut-off valve in series with the high pressure fluid supply conduit feeding each gun. This series arrangement of first and second shut-off valves in the fluid conduit between the pump discharge and each individual gun assures a fail-safe shut-off system which gives the operator of each gun the assurance that upon release of the water blast gun trigger that cessation of the water blast from the gun nozzle will occur. Accordingly, the likelihood of the operator falling over backwards upon release of the gun trigger is eliminated and risk of a dropped runaway water blast gun that failed to shut-off is eliminated.

12 Claims, 3 Drawing Figures

FAIL-SAFE HIGH PRESSURE FLUID DELIVERY SYSTEM

BACKGROUND OF THE INVENTION

This invention relates to a high pressure fluid delivery system for water blasting equipment using fluid pressures in the range of 10,000 to 20,000 psig or more. One of the principal aspects of the invention relates to a fail-safe fluid delivery system which employs series connected and redundant shut-off valves so that upon release of the gun trigger high pressure fluid flow through the gun tip will cease, even if one of the series connected shut-off valves should fail to operate. Another aspect of the invention is to a novel fluid delivery system which is particularly adaptable to a system of multiple high pressure water blasting guns which are fed from a single high pressure water delivery manifold and pump.

In typical prior art systems it is conventional to employ a so-called "dump gun" wherein the high pressure fluid is dumped at the gun prior to operation of the gun trigger mechanism. Typically such guns employ a trigger operated shut-off valve integral with the gun assembly which is physically controlled by the operator. In relatively low pressure water blasting equipment such mechanisms are reasonably suitable since the operator can physically and readily apply the necessary mechanical force to open or close the valve in the presence of the fluid pressure being delivered by the pump. However, as pump discharge pressures have increased to the 20,000 psig discharge range multiple dump guns with a single pump supply are not suitable because dumping of any one gun would deprive the other guns of fluid pressure. Accordingly, alternative control systems for the water blast gun have been devised wherein an electrical switch has been actuated by the gun trigger mechanism to remotely control a solenoid to pneumatically actuate a shut-off valve to supply high pressure liquid directly to the gun. These systems, therefore, did not dump the pressurized fluid at the operator's work station through the gun, but would relieve the pump discharge pressure either at the pump or some other location of the electrically operated pneumatic controlled dump valve. In each of these systems, however, only a single shut-off valve was employed for the control of the high pressure fluid discharged through the gun. While systems of this type have proved adequate for water blasting in the lower discharge pressure ranges, the advent of higher and higher pressure pumps in the range of 20,000 psig discharge pressure has made it more important that the operator be assured that the water blast gun will be shut-off upon his release of the gun trigger. The reason for this is that as the water blasting pressures have increased to these higher ranges the blast gun operator will shoulder the gun with ever increasing manual force to compensate for the higher discharge pressures. Upon shut-off of the gun by release of the trigger mechanism the reaction force immediately ceases and the gun operator must be alert not to fall over forward upon stopping of the gun blast. Accordingly, from experience, the gun operator expecting that the water blast will cease upon his release of the gun trigger, will automatically anticipate such and will lean back so that he does not fall forward upon stopping of the water blast from the gun nozzle. In the unlikely event that the shut-off valve, for one reason or another, does not stop the water blast upon release of the gun trigger an experienced operator, expecting such to occur, however, may fall over backwards in anticipation of the reduced force he is expecting from the gun. Accordingly, as water blasting pressures have increased more operator lean into the work piece has occurred and, accordingly, great reliance is placed by the operator on the gun trigger mechanism that it will be effective to shut-off the water flow through the gun nozzle when the trigger is released. Therefore, it has become considerably more important that as water discharge pressures have increased that the fluid delivery system be such as to assure the operator that shut-off will occur when he expects it to shut-off. Examples of prior art systems disclosed herebefore may be seen in applicant's prior U.S. Pat. Nos. 3,986,523 and 3,831,845.

SUMMARY OF THE INVENTION

With the foregoing in mind, the present invention contemplates a fluid delivery system for use with one or more individual water blast guns, each of which have an auxiliary shut-off valve integral with the gun and also include electric circuit completion means for operating a pneumatic secondary shut-off valve in series with the high pressure fluid supply conduit feeding each gun. This series arrangement of first and second shut-off valves in the fluid conduit between the pump discharge and each individual gun assures a fail-safe shut-off system which gives the operator of each gun the assurance that upon release of the water blast gun trigger that cessation of the water blast from the gun nozzle will occur. Accordingly, the likelihood of the operator falling over backwards upon release of the gun trigger is eliminated and risk of a dropped runaway water blast gun that failed to shut-off is eliminated.

Accordingly, a principal object of the invention is to provide a fail-safe, high pressure water blast shut-off system employing first and second shut-off valves in series with the fluid supply conduit.

Another object of the invention is to provide a novel overall multi-gun fluid delivery system with redundant shut-off valves to assure positive shut-off of each gun upon release of their respective trigger mechanisms.

A still further object of the invention is to provide a novel shut-off valve design employing a pneumatic actuating cylinder and pressure equilization passageways to assure operational reliability.

A still further object of the invention is to provide a novel secondary shut-off valve mounted within the gun assembly proper which may function to stop flow through the gun even if the primary remote controlled shut-off valve should fail.

A still further object of the invention is to provide a redundant shut-off valving system which is simple in design, rugged in construction, and economical to manufacture.

These and other objects and advantages of the invention will become apparent and the invention will be fully understood from the following description and drawings.

DETAILED DESCRIPTION OF THE INVENTION

Figure 1:
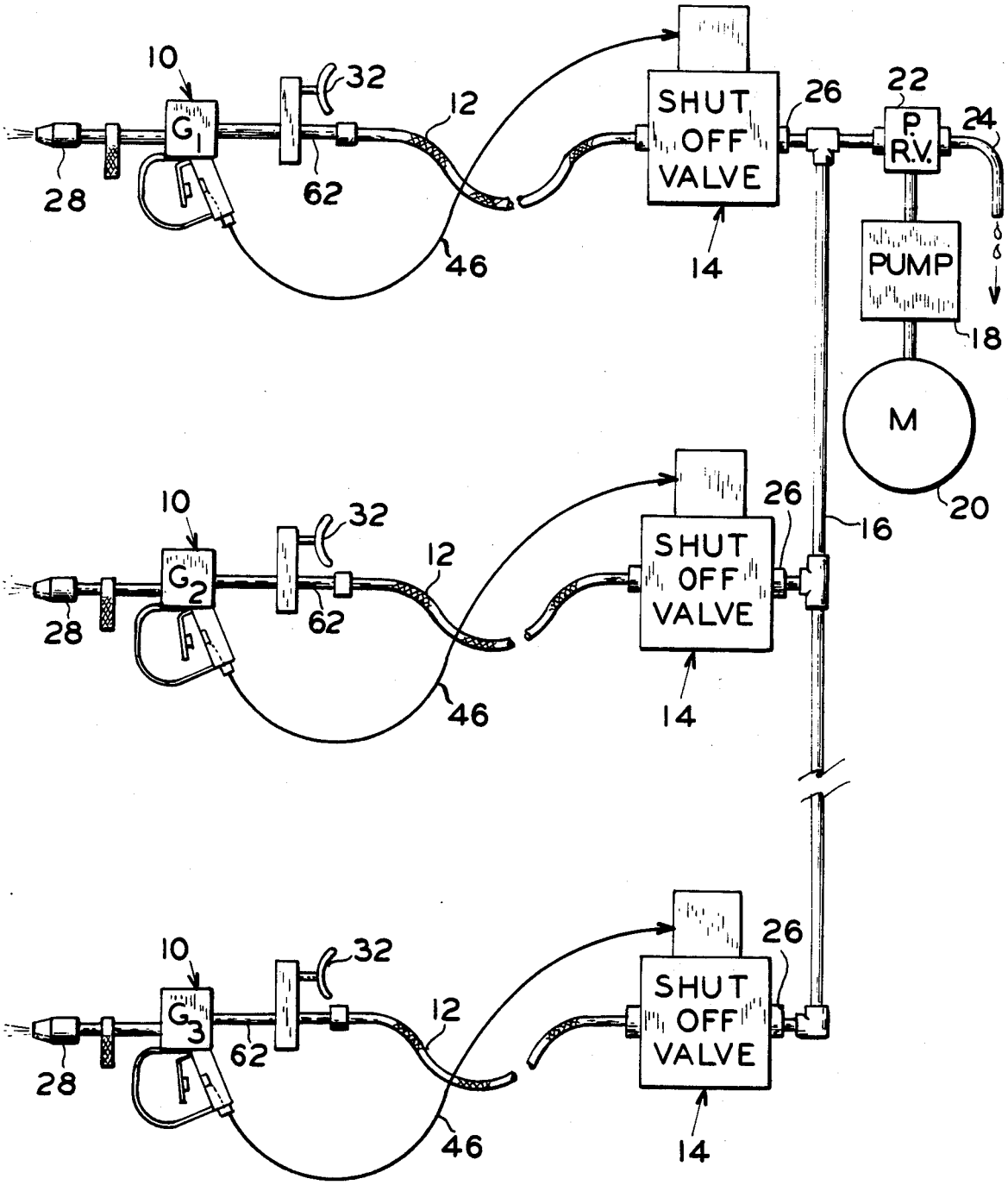
FIG. 1, schematic lay-out of the invention employing three separate water blast guns connected to a common manifold fed from a single high pressure delivery fluid pump.

Referring to the drawings, three high pressure fluid blasting guns designated 10 are indicated as $G_1$, $G_2$ and $G_3$. Each gun 10 is connected to a fluid supply hose 12, in turn connected to a respective solenoid shut-off valve assembly generally designated 14. Valves 14 include an inlet connection 26 to place each valve in fluid communication with a feed supply of fluid contained in the high pressure manifold 16. The manifold 16 is fed by the discharge of a high pressure pump generally designated 18 driven by a motor or other prime mover 20. The pump 18 also includes a pressure regulator valve 22 which functions to dump excess pressure in the manifold 16 through conduit 24 whenever the manifold exceeds a predetermined, desired maximum pressure, such as 20,000 psig. A suitable pressure regulator valve for such purpose may be of the type disclosed in applicant's co-pending patent application, U.S. Ser. No. 663,811.

Figure 2:
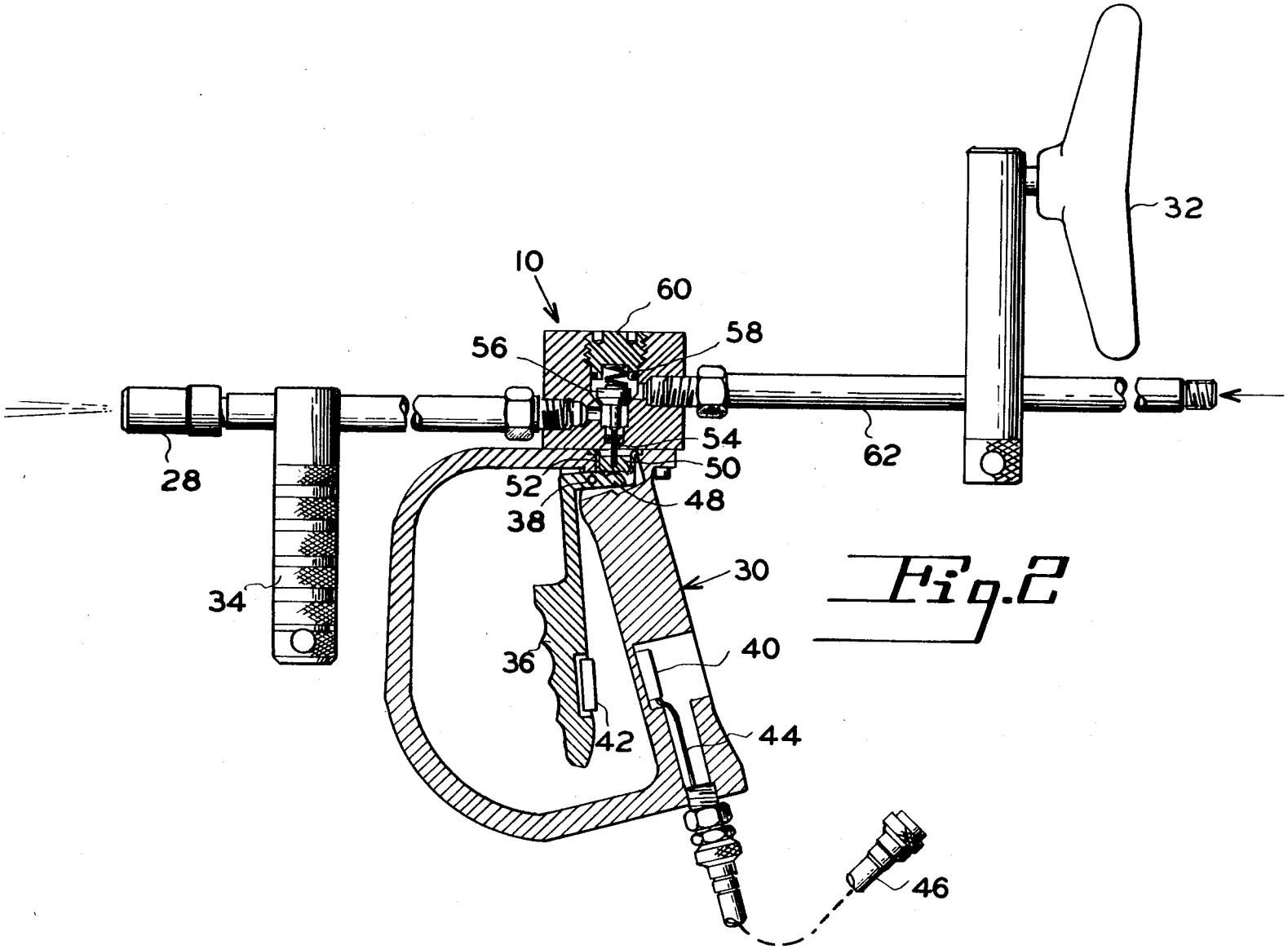
FIG. 2 is an enlarged view, partially in cross section, showing a water blast gun in accordance with the present invention.

Referring to FIG. 2 it will be seen that each of the blasting guns 10 includes a spray tip 28, a primary handgrip or grasp handle 30 and an operator shoulder rest 32. A secondary handle 34 is placed forward of the primary handle 30 a convenient distance therefrom to allow a comfortable grip of the gun in the operator's two hands. The primary handgrip 30 includes a trigger 36 rotatable about an upper pivot pin 38 attached to the body of the gun. The trigger 38 carries a magnetic element 42 which when moved into the proximity to a magnetic reed switch 40 is effective to close the electrical circuit in the conductors 44. Electrical conductors 44 communicate through the protective cable sheathing 46 to allow an electrical power source (not shown) to energize a solenoid winding included within solenoid 100 (see FIG. 3).

It will be seen that the upper portion of the trigger 36 includes an extending pivot arm 48 adjacent the pin 38 which is in contact with a button 50 engaging the lower end of a valve stem 54. Suitable elastic seal means 52 surround the button 50 to prevent leakage of pressurized fluid. As the trigger 36 is operated to place the magnet 42 into close proximity with the reed switch 40, the pivot arm 48 acting through the button 50 raises the stem 54 to unseat the valve piston 56 and compress a coil return spring 58 in an upward direction against the end plug 60. This operation of the trigger, therefore, will be seen to allow passage of high pressure fluid contained in the supply conduit 62 around the seat of the valve piston 56 to supply high pressure fluid to the spray tip 28. At the same time that the trigger 36 is operated the electrical activation of the winding in the solenoid 100 is such to supply high pressure pneumatic fluid in air supply conduit 102 to the upper chamber above piston 94 (see FIG. 3).

Figure 3:
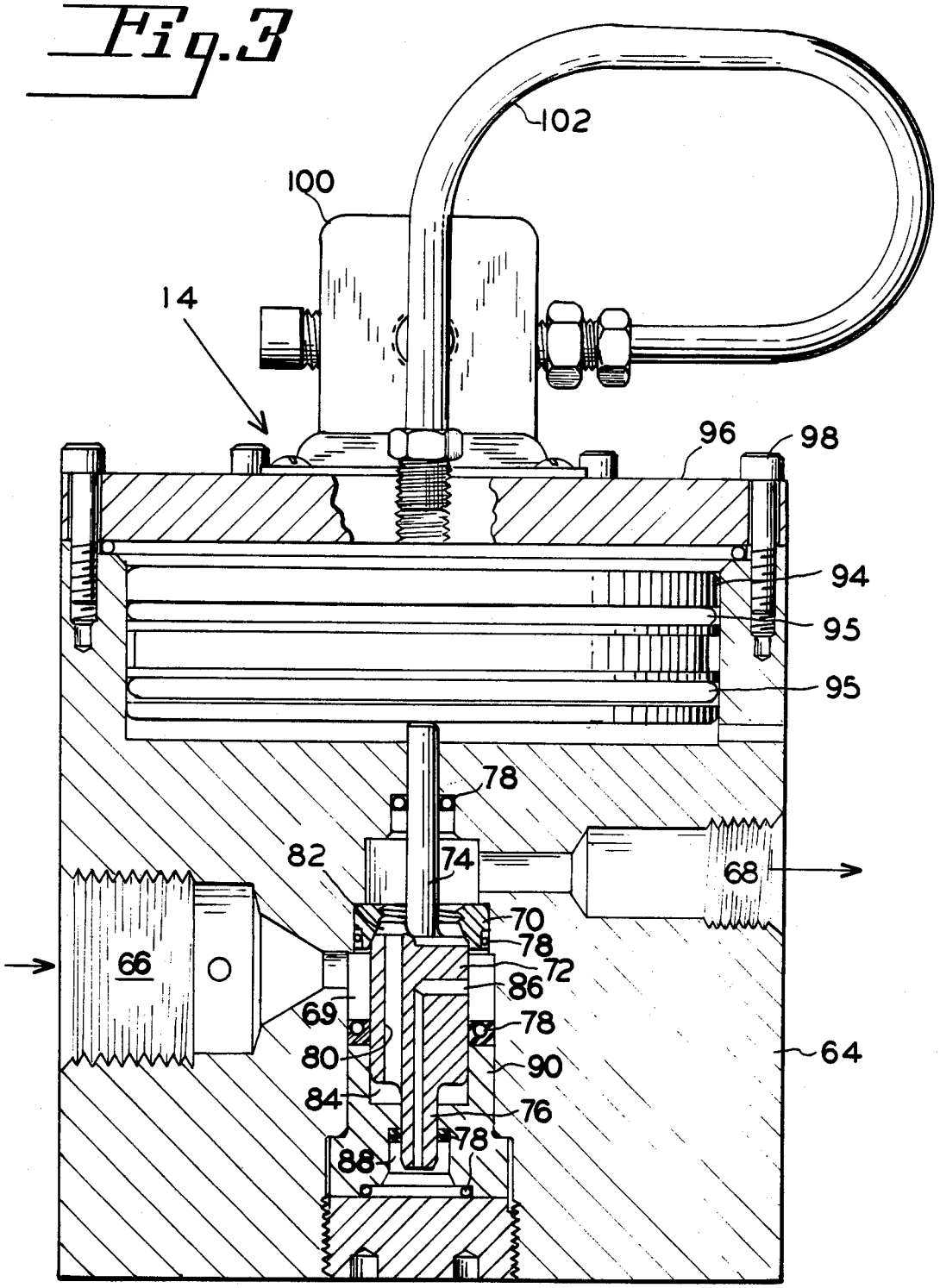
FIG. 3 is a vertical cross sectional view of the secondary, remote controlled shut-off valve of FIG. 1.

Referring to FIG. 3 in more detail, the solenoid operated or secondary shut-off valve assembly 14 includes a body 64 having a pressurized fluid inlet connection 66 adapted to be threaded to the valve inlet connection 26 (see FIG. 1). The valve body 64 also includes an outlet connection 68 in communication with the flexible supply hose 12. A central bore 69 in said body includes a seat member 70 in an upper portion thereof which cooperates with a valve piston 72 having a pair of end pilot stem extensions designated 74 and 76, respectively. A plurality of seal means designated 78 are provided between the various cooperating parts of the piston 72 and the valve body 64 to effect fluid seal, as required. The valve piston 72 includes a first passageway 86 which is in communication with the pressurized fluid inlet 66 to transfer such inlet pressure to a lower end chamber 88. The high pressure in chamber 88 is effective, therefore, to position the piston 72 upwardly in tight sealing engagement against its valve seat 70 to prevent flow of fluid from inlet passageway 66 to outlet passageway 68. The valve piston 72 also includes a second equilization passageway which is effective to place the discharge chamber 82 in fluid communication with an intermediate chamber 84 below the piston 72. The lower portion of the bore 69 is provided with a valve piston guide 90 which, in cooperation with the end surface of the piston 72, defines the aforementioned intermediate chamber 84 therebetween. The valve piston guide 90 is held in the body 64 of the valve by a threaded end guide retainer 92. As previously described, when the electrical circuit is completed by the operation of the gun trigger 36, pneumatic air pressure is applied to the upper potion of the piston 94 sealed by a pair of O-ring seals 95 to contact and depress the extension 74 of the piston 72 to unseat the piston from the seat 70 allowing the fluid under pressure from the inlet 66 to flow through the valve bore 69 to the outlet 68. Upon opening of the electrical circuit and removal of air pressure from the upper surface of piston 94, the valve piston 72 may readily reseat against seat 70 since chamber 88 will be at the inlet fluid pressure via the passageway 86 but because of the pressure equilization passageway 80 equal end pressures will be present on the valve in chambers 82 and 84 and, therefore, readily permitting its return to its closed or seated position upon breaking of the electrical circuit by release of the gun trigger. The upper portion of the valve body 64 is suitably enclosed by a cover plate 96 held by appropriate cap screws 98.

From the foregoing description it can be seen that in operation the activation of the trigger 36 will simultaneously open the first shut-off valve 10 at the same time that the second shut-off valve 14 opens thereby placing the manifold 16 in fluid communication with one or more of the water gun blast tips 28. At the time that the gun operator releases the trigger the fluid pressure in conduit 62 will act upon the upper surface of piston 56 in concert with the return spring 58 force and shut-off the gun valve. At the same time the manifold fluid pressure will be effective to pressurize the end chamber 88 to return the piston 72 in the second shut-off valve 14 against its respective seat 70. It should be understood that in this state the fluid conduit between the gun shut-off valve and the solenoid shut-off valve will be filled with fluid nominally at the manifold discharge pressure. However, the design of the gun shut-off valve seat includes a bleed passageway (not shown) to gradually depressurize the captive static pressure that would otherwise remain in the connecting conduit 62 and hose 12 so that upon the operator's desire to resume water blasting the force required to operate the trigger 38 is relatively small and need not overcome the 20,000 psi fluid pressure that might be present in conduit 62 and hose 12.

While a specific embodiment of the invention has been shown and described in detail to illustrate the application of the inventive principles, it will be understood that the invention may be embodied otherwise without departing from such principles.

What is claimed is:

1. In a fluid delivery system for supplying a high pressure stream of fluid to at least one hand-held fluid blasting gun, including a pump having a high pressure outlet manifold and a pressure regulating valve for dumping fluid discharged by said pump whenever the pressure in said outlet manifold exceeds a predetermined maximum, and a first fluid conduit between said outlet manifold and said gun, the improvement comprising at least one liquid blasting gun having a trigger operated first fluid shut-off valve therein, said valve including; a spring to bias said valve into a normally closed position, trigger means to mechanically bias said shut-off valve to an open position, and electrical switch means to complete an electrical conduit when said trigger means is operated to open said first valve, said electrical circuit including an electrically operated solenoid valve connected to a pressurized air supply to actuate an associated high pressure fluid second shut-off valve, said second shut-off valve being located in said first fluid conduit between said gun and said pump outlet manifold and in series with said first shut-off valve, said second shut-off valve comprising; a body portion, a fluid inlet port, a fluid outlet port, a cylindrical bore in fluid communication with said inlet port, a valve piston reciprocal within said cylindrical bore, valve seat means in one end of said bore, said piston having a first end arranged for seating engagement with said valve seat means to stop fluid flow between said inlet port and said outlet port, a first passageway in said valve piston to place the fluid pressure in said inlet port in fluid communication with a second end of said piston to force said piston into contact with said valve seat means, a second passageway in said piston to place the fluid pressure in said outlet port in fluid communication with a pressure equilization chamber intermediate said piston first and second ends, and a pneumatic piston in said second shut-off valve body portion responsive to said pressurized air supply, said pneumatic piston including means to displace said valve piston from said valve seat means to place said fluid inlet port in fluid communication with said fluid outlet port upon operation of said trigger and completion of said electrical circuit, whereby substantially simultaneous opening and closing of each of said series connected first and second fluid shut-off valves will occur upon operation and release of said trigger.

2. The combination of claim 1 wherein said first shut-off valve includes a piston and valve seat cooperative therewith.

3. The combination of claim 2 wherein said second shut-off valve piston first end includes a central stem extension extending through a bore in said body portion into surface contact with said pneumatic piston.

4. The combination of claim 3 wherein said second passageway in communication with said equilization chamber is effective to assist the inlet port fluid pressure at said piston second end to assure closing of said valve.

5. The combination of claim 2 further including at least two liquid blasting guns, each being connected to said pump outlet manifold through respective individual fluid conduits, each said fluid conduit including a second shut-off valve as aforesaid described.

6. The combination of claim 2 wherein said electrical switch means includes a magnetically operated reed switch.

7. In a fluid delivery system for supplying a high pressure stream of fluid to at least one hand-held fluid blasting gun, including a pump having a high pressure outlet manifold for supplying fluid at pressures between 10,000 psig and 20,000 psig and a pressure regulating valve for dumping fluid discharged by said pump whenever the pressure in said outlet manifold exceeds a predetermined maximum, and a flexible first fluid conduit between said outlet manifold and said gun, the improvement comprising a fail-safe fluid shut-off system for a liquid blasting gun having a trigger operated first fluid shut-off valve therein, said valve including; a spring to bias said valve into a normally closed position, trigger means to open said shut-off valve, and electrical switch means to complete an electrical circuit when said trigger means is operated to open said first valve, said electrical circuit including an electrically operated solenoid valve connected to a pressurized air supply to actuate an associated high pressure fluid second shut-off valve, said second shut-off valve being connected to said flexible first fluid conduit and to said pump outlet manifold and in series with said first shut-off valve, said second shut-off valve comprising; a body portion, a fluid inlet port, a fluid outlet port, a cylindrical bore in fluid communication with said inlet port, a valve piston reciprocal within said cylindrical bore, valve seat means in one end of said bore, said piston having a first end arranged for seating engagement with said valve seat means to stop fluid flow between said inlet port and said outlet port, a first passageway in said valve piston to place the fluid pressure in said inlet port in fluid communication with a second end of said piston to force said piston into contact with said valve seat means, a second passageway in said piston to place the fluid pressure in said outlet port in fluid communication with a pressure equilization chamber intermediate said piston first and second ends, and a pneumatic piston in said second shut-off valve body portion responsive to said pressurized air supply, said pneumatic piston including means to displace said valve piston from said valve seat means to place said fluid inlet port in fluid communication with said fluid outlet port upon operation of said trigger and completion of said electrical circuit, whereby substantially simultaneous opening and closing of each of said series connected first and second fluid shut-off valves will occur upon release of said trigger and fluid discharge will stop from said gun upon release of said trigger even upon malfunction of either of said first or second shut-off valves.

8. The combination of claim 7 wherein said first shut-off valve includes a piston and valve seat cooperative therewith.

9. The combination of claim 8 wherein said second shut-off valve piston first end includes a central stem extension extending through a bore in said body portion into surface contact with said pneumatic piston.

10. The combination of claim 9 wherein said second passageway in communication with said equilization chamber is effective to assist the inlet port fluid pressure at said piston second end to assure closing of said valve.

11. The combination of claim 10 further including at least two liquid blasting guns, each being connected to said pump outlet manifold through respective individual fluid conduits, each said fluid conduit including a second shut-off valve as aforesaid described.

12. The combination of claim 11 wherein said electrical switch means includes a magnetically operated reed switch.

* * * * *